US008009118B2

(12) United States Patent
Son et al.

(10) Patent No.: US 8,009,118 B2
(45) Date of Patent: Aug. 30, 2011

(54) OPEN-ENDED TWO-STRIP MEANDER LINE ANTENNA, RFID TAG USING THE ANTENNA, AND ANTENNA IMPEDANCE MATCHING METHOD THEREOF

(75) Inventors: Hae-Won Son, Daejon (KR); Won-Kyu Choi, Daejon (KR); Gil-Young Choi, Daejon (KR); Cheol-Sig Pyo, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 844 days.

(21) Appl. No.: 11/494,260

(22) Filed: Jul. 27, 2006

(65) Prior Publication Data

US 2007/0023525 A1 Feb. 1, 2007

(30) Foreign Application Priority Data

Jul. 27, 2005 (KR) ..... 10-2005-0068549
Feb. 10, 2006 (KR) ..... 10-2006-0012796

(51) Int. Cl.
*H01Q 1/38* (2006.01)

(52) U.S. Cl. ..... 343/806

(58) Field of Classification Search ..... 343/700 MS, 343/702, 806, 895; 340/572.7
See application file for complete search history.

(56) References Cited

U.S. PATENT DOCUMENTS 4,054,874 A * 10/1977 Oltman, Jr. ..... 343/700 MS
4,656,463 A 4/1987 Anders et al.
5,942,987 A 8/1999 Heinrich et al.
6,028,564 A 2/2000 Duan et al.
6,097,347 A 8/2000 Duan et al.
6,118,379 A * 9/2000 Kodukula et al. ..... 340/572.8
6,285,342 B1 9/2001 Brady et al.
6,535,175 B2 3/2003 Brady et al.
6,642,893 B1 * 11/2003 Hebron et al. ..... 343/702
6,903,692 B2 * 6/2005 Kivekas et al. ..... 343/702

FOREIGN PATENT DOCUMENTS

KR 10-2002-0065811 8/2002
KR 1020020096016 12/2002

OTHER PUBLICATIONS

Notice of Preliminary Rejection from Korean Intellectual Property Office, Corresponding Korean Application No. 10-2006-0012796, Mar. 30, 2007.

'A Compact Broad-Band Helical Antenna With Two-Wire Helix' Noguchi et al., IEEE Transactions on Antennas and Propagation, vol. 51, No. 9, Sep. 2003, pp. 2176-2181.

Hae Won Son, et al; "Open-Ended Two-Strip Meander-Line Antenna for RFID Tags", ETRI Journal, vol. 28, No. 3, Jun. 2006, pp. 383-385.

* cited by examiner

*Primary Examiner* — Michael C Wimer
(74) *Attorney, Agent, or Firm* — Ladas & Parry LLP

(57) ABSTRACT

An open-ended two-strip meander line antenna, an RFID tag using the same and an antenna impedance matching method thereof are provided. The antenna includes: a radiating strip line for deciding a resonant frequency of the antenna; and a feeding strip line for providing a radio frequency (RF) signal to an element connected to the antenna, wherein ends of the radiating strip line and the feeding strip line are open.

53 Claims, 6 Drawing Sheets

OPEN-ENDED TWO-STRIP MEANDER LINE ANTENNA, RFID TAG USING THE ANTENNA, AND ANTENNA IMPEDANCE MATCHING METHOD THEREOF

FIELD OF THE INVENTION

The present invention relates to an open-ended two-strip meander line antenna, a radio frequency identification (RFID) tag using the antenna, and an antenna impedance matching method thereof.

DESCRIPTION OF RELATED ARTS

A radio frequency identification (RFID) tag is widely used with an RFID reader or an RFID interrogator in various fields such as materials management and security management. Generally, if an object with an RFID tag attached is placed in the read zone of an RFID reader, the RFID reader transmits an interrogation signal to the RFID tag by modulating a radio frequency (RF) signal having a predetermined carrier frequency, and the RFID tag responses the interrogation signal transmitted from the RFID reader. That is, the RFID reader transmits the interrogating signal to the RFID tag by modulating a continuous electromagnetic wave having a predetermined frequency. Then, the RFID tag modulates the electromagnetic wave transmitted from the RFID reader using a back-scattering modulation scheme and returns the back-scattering modulated electromagnetic wave to the RFID reader in order to transmit the information stored in an internal memory of the RF tag to the RFID reader. The back-scattering modulation is a method of transmitting the information of an RFID tag by scattering the electromagnetic wave transmitted from the RFID reader, modulating the intensity or the phase of the scattered electromagnetic wave and transmitting the information of the RFID tag to the RFID reader.

A passive RFID tag uses the electromagnetic wave transmitted from the RFID reader as its power source by rectifying the electromagnetic wave in order to obtain the driving power. In order to normally drive the passive RFID tag, the intensity of the electromagnetic wave transmitted from the RFID reader must be stronger than a predetermined threshold value at a location where the RFID tag is placed. That is, the read zone of the RFID reader is defined by the intensity of the electromagnetic wave that is transmitted from the RFID reader and reaches at the RFID tag. However, the transmitting power of the RFID reader cannot increase infinitely because the transmitting power of the RFID reader is restricted by the local regulation of each country such as Federal Communication Commission (FCC) of the U.S. Therefore, in order to widen the read zone without increasing the transmitting power of the RFID reader, the RFID tag must effectively receive the electromagnetic wave transmitted from the RFID reader.

One of conventional methods for improving the efficiency of the RFID tag is a method using an additional matching circuit was introduced. Generally, the RFID tag includes an antenna, an RF front-end, and a signal processor. The RF front-end and the signal processor are manufactured in one chip. The conventional method using the matching circuit maximizes the intensity of the signal transmitted from the antenna to the RF front-end by performing conjugate-matching of the antenna and the RF front-end using the additional matching circuit. However, the additional matching circuit occupies the large area in the chip because the matching circuit is composed of capacitors and inductors. Therefore, the conventional method using the additional matching circuit has a drawback in the respect of integrity and production costs.

SUMMARY OF THE INVENTION

It is, therefore, an object of the present invention to provide an antenna having a broadband characteristic and allowing the input impedance of the antenna to be controlled by disposing two meander strip lines at both sides of a substrate, respectively, as a radiating unit and a feeding unit and controlling the electromagnetic coupling amount of the two meander strip lines.

It is another object of the present invention to provide an antenna for reducing a manufacturing cost of a tag and allowing mass production by opening ends of two strip lines without forming a via penetrating the substrate.

It is still another object of the present invention to provide a radio frequency identification (RFID) tag capable of effective broadband matching to an RF front-end having a large capacitive reactance against resistance through the antenna.

In accordance with an aspect of the present invention, there is provided an antenna including: a radiating strip line for deciding a resonant frequency of the antenna; and a feeding strip line for providing a radio frequency (RF) signal to an element connected to the antenna, wherein ends of the radiating strip line and the feeding strip line are open.

In accordance with another aspect of the present invention, there is also provided a radio frequency identification (RFID) tag, including: an antenna for receiving an RF signal transmitted from an RFID reader; an RF front-end for rectifying and detecting the RF signal; and a signal processing unit connected to the RF front-end, wherein the antenna includes: a radiating strip line for deciding a resonant frequency of the antenna; and a feeding strip line for providing a radio frequency (RF) signal to an element connected to the antenna, wherein ends of the radiating strip line and the feeding strip line are open.

In accordance with yet another aspect of the present invention, there is also provided an antenna impedance matching method for an open-ended strip line antenna having a radiating strip line for deciding a resonant frequency of the antenna, and a feeding strip line for providing an RF signal to an element connected through a terminal, where the feeding strip line and the radiating strip line are disposed at both sides of a substrate and are electromagnetically coupled each other, the antenna impedance matching method including the step of: matching an impedance using a characteristic that an impedance of the radiating strip line is shown at the terminal of the feeding strip line by being transformed to a predetermined impedance step-up ratio through an electromagnetic coupling of the radiating strip line and the feeding strip line.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, an open-ended two strip meander line antenna, an RFID tag using the antenna, an antenna impedance matching method thereof in accordance with a preferred embodiment of the present invention will be described in more detail with reference to the accompanying drawings.

Figure 1:
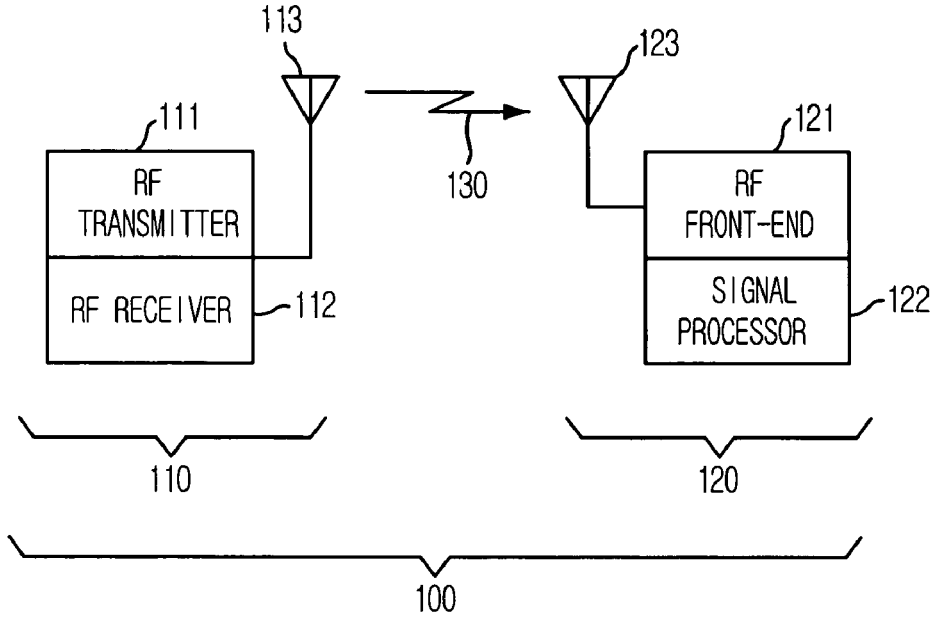
FIG. 1 is a block diagram of an RFID system where the present invention is applied.

FIG. 1 is a block diagram of an RFID system 100 where the present invention is applied.

Referring to FIG. 1, the RFID system 100 includes an RFID tag 120 for storing information thereof, an RFID reader 110 having an analyzing and a decoding function, and a host computer (not shown) for reading data from the RFID tag 120 through the RFID reader 110 and processing the read data.

The RFID reader 110 includes an RF transmitter 111, an RF receiver 112, and a reader antenna 113. The reader antenna 113 is electrically connected to the RF transmitter 111 and the RF receiver 112. The RFID reader 110 transmits an RF signal to the RFID tag 120 through the RF transmitter 111 and the reader antenna 113. The RFID reader 110 receives an RF signal from the RFID tag 120 through the reader antenna 113 and the RF receiver 112. As introduced in U.S. Pat. No. 4,656,463, the structure of the RFID reader 110 is well known to those skilled in the art. Therefore, the detailed description thereof is omitted.

The RFID tag 120 includes an RF front-end 121, a signal processor 122 and a tag antenna 123 in accordance with an embodiment of the present invention. In case of a passive RFID tag, the RF front-end 121 supplies a necessary power to the signal processor 122 by transforming a received RF signal to a DC voltage. Also, the front-end 121 extracts a baseband signal from the received RF signal. As introduced in U.S. Pat. No. 6,028,564, the constitution of the RF front-end is well known to those skilled in the art. Therefore, detail description thereof is omitted. The signal processor 122 also has a widely known constitution to those skilled in the art as introduced in U.S. Pat. No. 5,942,987.

Hereinafter, the operations of the RFID system 100 will be described. The RFID reader 110 sends an interrogation signal to the RFID tag 120 by modulating an RF signal with a predetermined carrier frequency. The RF signal created from the RF transmitter 111 of the RFID reader 110 is externally transmitted through an antenna 113 as the form of an electromagnetic wave. Then, the electromagnetic wave 130 is transmitted from the reader antenna 113 to the tag antenna 123. The tag antenna 123 transfers the received electromagnetic wave 130 to the RF front-end 121. If the intensity of the RF signal transferred to the RF front-end 121 is stronger than a minimum requested power to drive the RFID tag 120, the RFID tag 120 reposes to the interrogation signal transmitted from the RFID reader 110 by modulating the electromagnetic wave 130 using the back-scattering modulation.

In order to widen the read zone of the RFID reader 110, the intensity of the electromagnetic wave 130 transmitted from the RFID reader 110 must be strong enough to provide a driving power to the RFID tag 120. Also, the electromagnetic wave 130 transmitted from the RFID reader 110 must be transferred to the RF front-end 131 without any loss using the high efficient tag antenna 123. That is, in order to provide the high efficiency to the tag antenna 123, the carrier frequency of the RF reader 110 must have a resonant characteristic and must be conjugate-matched with the RF front-end 121.

Figure 2:
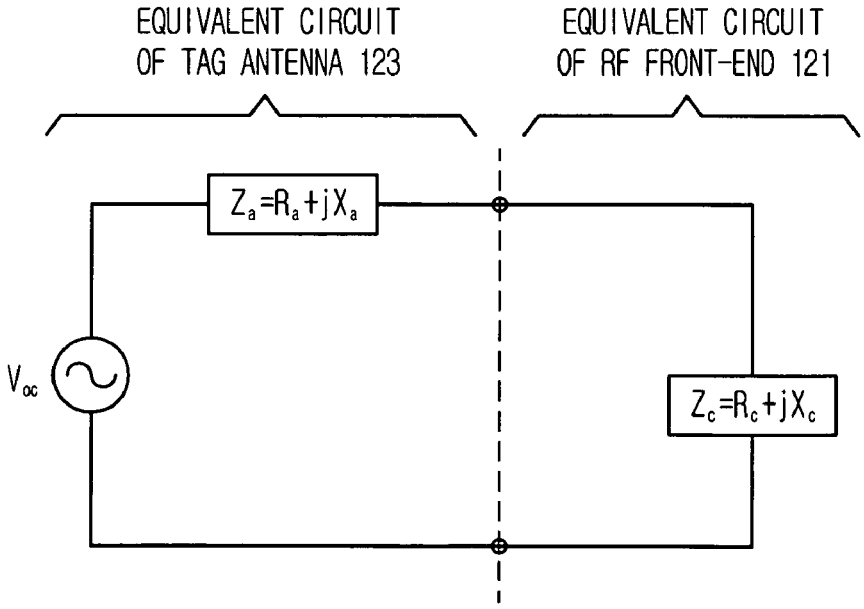
FIG. 2 is an equivalent circuit diagram of a tag antenna and an RF front-end of FIG. 1.

FIG. 2 is an equivalent circuit diagram of the tag antenna 123 and the RF front-end 121 of FIG. 1.

Referring to FIG. 2, the circuit includes a voltage source $V_\propto$, an antenna impedance $Z_a$ and an RF front-end impedance $Z_c$. The voltage source $V_\propto$ and the antenna impedance $Z_a$ are the equivalent circuit of the tag antenna 123. The RF front-end impedance $Z_c$ is the equivalent circuit of the RF front-end 121. The antenna impedance has a real number part $R_a$ and an imaginary number part $X_a$. The real number part $R_a$ denotes the equivalent resistance of the tag antenna 123, and the imaginary number part $X_a$ denotes the equivalent reactance of the tag antenna 123. The RF front-end impedance also has a real number part $R_c$ and an imaginary number part $X_c$. The real number part $R_c$ denotes the equivalent resistance of the RF front-end 121, and the imaginary number part $X_c$ denotes the equivalent reactance of the RF front-end 121.

In general, the maximum power is transferred from the tag antenna 123 to the RF front-end 121 if the antenna impedance $Z_a$ and the RF front-end impedance $Z_c$ are conjugate-matched. The conjugate matching is to make two complex impedances to have the same absolute impedance value and to have the opposite phases. That is, if the impedance of the tag antenna 123 or the impedance of the RF front-end 121 is controlled to be $R_a=R_c$, and $X_a=-X_c$, the maximum power is transferred from the tag antenna 123 to the RF front-end 121.

Generally, the RF front-end 121 of a passive or a semi-passive RFID tag includes a rectifier circuit and a detector circuit using a diode and does not include an additional matching circuit in order to reduce the size of the chip thereof. Therefore, the impedance of the RF front-end 121 has a complex impedance different from about 50Ω in general. Also, the impedance of the RF front-end 121 has a small resistance component $R_c$ and a large capacitive reactance component $X_c$ in a ultra high frequency (UHF) band due to the characteristics of the rectifier and the detector circuit. Therefore, the antenna impedance $Z_a$ for the conjugate matching must have a small resistance component $R_a$ and a large inductive reactance component $X_a$, and they must be resonated by the frequency of the electromagnetic wave transmitted from the RFID reader at the same time.

Figure 3:
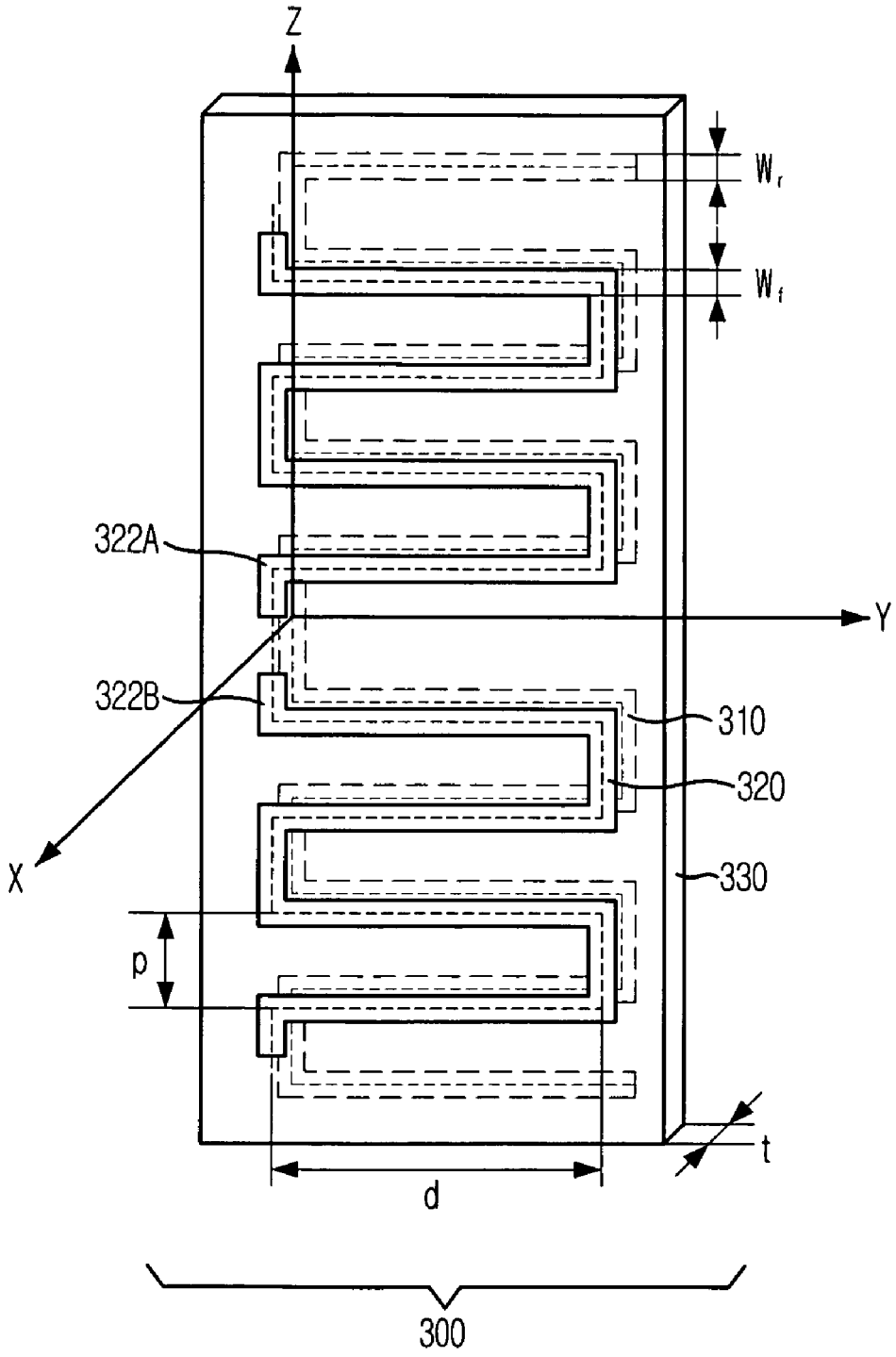
FIG. 3 is a view illustrating a tag antenna using open-ended two-strip meander lines in accordance with an embodiment of the present invention.

FIG. 3 is a view illustrating a tag antenna 300 using open-ended two-strip meander lines in accordance with an embodiment of the present invention.

Referring to FIG. 3, the tag antenna 300 includes a radiating strip line 310 and a feeding strip line 320. The radiating strip line 310 and the feeding strip line 320 are disposed at the both sides of the same substrate 330, respectively. The radiating strip line 310 and the feeding strip line 320 have the same meander structures having the center lines matched each other. The feeding strip line 320 includes terminals 322A and 322B at a center portion thereof to be connected to an RF front-end 121. As shown in FIG. 3, the radiating strip line 310 and the feeding strip line 320 have the same pitch P and the same horizontal width length d. However, the feeding strip line 320 may have a line width $w_f$ and a length $l_f$ different from a line width $w_r$ and a length $l_r$ of the radiating strip line. Herein, the lengths $l_f$ and $l_r$ of the feeding strip line 320 and the radiating strip line 310 denote a meander line length from a center point of the meander structure shown in FIG. 3, for example, x=t or 0, y=0, z=0, to the end of the strip line. That is, the lengths if and $l_r$ denote an unfolded length.

The resonant frequency of the radiating strip line 310 is decided by the resonant frequency of the entire tag antenna 300. Also, the structure of the radiating strip line 310 is a major factor that decides a real number part $R_a$ of the tag antenna 300's impedance at the resonant frequency. Meanwhile, in the tag antenna 300, the radiating strip line 310 and the feeding strip line 320 are electromagnetically coupled each other, and the electromagnetic connection of the feeding strip line 320 and the radiating strip line 310 functions as an impedance transformer. That is, the equivalent impedance of the radiating strip line 310 including a radiation resistance becomes shown at the terminals 322A and 322B of the feeding strip line 320 by being transformed to a predetermined ratio through the electromagnetic coupling. The impedance transforming is identical to an impedance transforming scheme using a transformer which has been widely used in a low frequency band.

Figure 4:
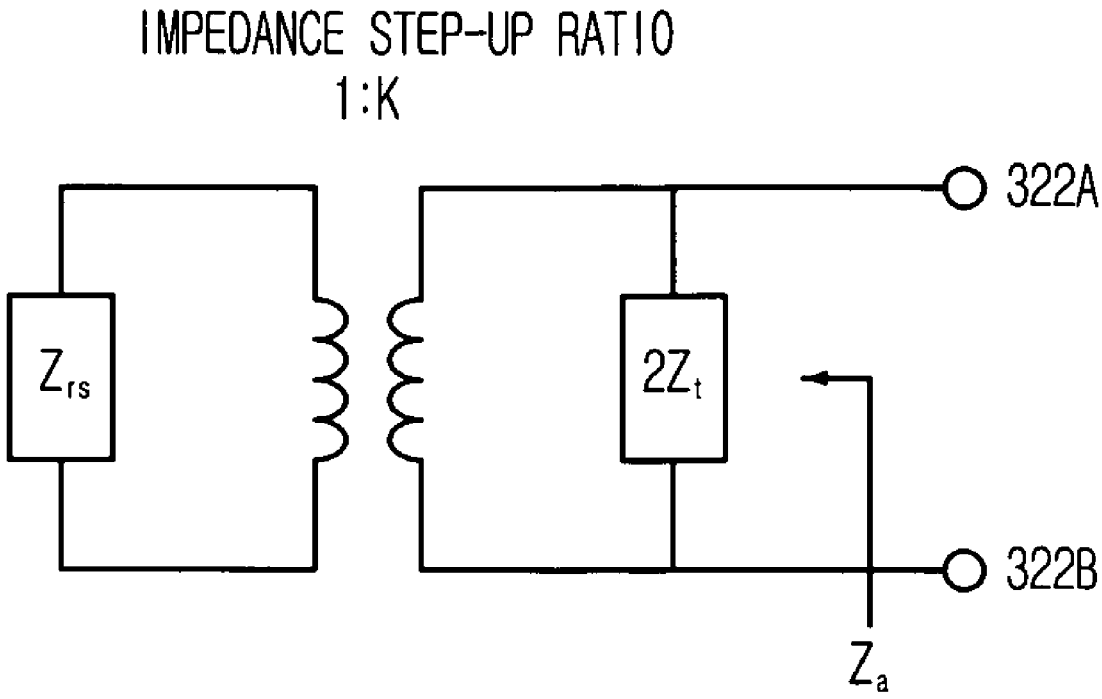
FIG. 4 is an equivalent circuit diagram of a tag antenna of FIG. 3.

FIG. 4 is an equivalent circuit diagram of the tag antenna 300 of FIG. 3.

Referring to FIG. 4, the equivalent circuit diagram includes an equivalent impedance $Z_{rs}$ of the radiating strip line 310, an equivalent impedance $Z_t$ of an end-opened transmission line composed of the radiating strip line 310 and the feeding strip line 320, and a transformer having an impedance set-up ration 1:k'.

The impedance $Z_{rs}$ of the radiating strip line 310 around the resonant frequency $f_o$ of the tag antenna can be expressed as Eq. 1 using a quality factor $Q_{rs}$ of the radiating strip line.

$$Z_{rs} = R_{rs} + jR_{rs}Q_{rs}\left(\frac{f}{f_0} - \frac{f_0}{f}\right) = R_{rs}(1 + ju) \quad \text{Eq. 1}$$

In Eq. 1, f is an operating frequency, $R_{rs}$ denotes a radiation resistance when $f=f_o$, and $$u = Q_{rs}\left(\frac{f}{f_o} - \frac{f_o}{f}\right).$$

From Eq. 1, the admittance $Y_{rs}$ of the radiating strip line 310 can be given as Eq. 2.

$$Y_{rs} = \frac{1}{Z_{rs}} = G_{rs} + jB_{rs} \quad \text{Eq. 2}$$

In Eq. 2, $G_{rs}$ and $B_{rs}$ denote the conductance and the susceptance of the radiating strip line, and they may be given as Eq. 3 and Eq. 4.

$$G_{rs} = \frac{1}{R_{rs}}\frac{1}{1+u^2} \quad \text{Eq. 3}$$

$$B_{rs} = -\frac{1}{R_{rs}}\frac{u}{1+u^2} \quad \text{Eq. 4}$$

Meanwhile, the equivalent impedance $Z_t$ of the end-opened transmission line composed of the radiating strip line and the feeding strip line can be expressed as Eq. 5.

$$Z_t = -jZ_0 \cot \beta l_t \quad \text{Eq. 5}$$

In Eq. 5, $Z_o$ denotes the characteristic impedance of a transmission line; β is the propagation constant of a transmission line; and $l_t$ denotes the length of a transmission line. The characteristic impedance $Z_o$ is a function of a thickness of a substrate, a relative dielectric constant and the line widths $w_j$ and $w_r$ of two strip lines. In the present invention, the length $l_f$ of the feeding strip line is limited to be equal to or shorter than the length $l_r$ of the radiation strip line, that is, $l_f \leqq l$. Therefore, $l_t \cong l_f$.

From Eq. 5, the admittance $Y_r$ of the transmission line includes two strip lines is given as Eq. 6.

$$Y_t = \frac{1}{Z_t} = jB_t \quad \text{Eq. 6}$$

In Eq. 6, $B_t$ denotes a susceptance of a transmission line includes two strip lines, and can be expressed as Eq. 7.

$$B_t = \frac{1}{Z_0}\tan(\beta l_f) \quad \text{Eq. 7}$$

In views from the both ends 332A and 332B of the feeding strip line 320, the input admittance $Y_a$ of the tag antenna 300 can be expressed as Eq. 8.

$$Y_a = G_a + jB_a = \frac{1}{k}Y_{rs} + \frac{1}{2}Y_t \quad \text{Eq. 8}$$

In Eq. 8, $G_a$ and $B_a$ denote the conductance and the susceptance of the entire antenna, and can be expressed Eqs. 9 and 10.

$$G_a = \frac{1}{k}G_{rs} = \frac{1}{k}\frac{1}{R_{rs}}\frac{1}{1+u^2} \quad \text{Eq. 9}$$

$$B_a = \frac{1}{k}B_{rs} + \frac{1}{2}B_t = -\frac{1}{k}\frac{1}{R_{rs}}\frac{u}{1+u^2} + \frac{1}{2}\frac{1}{Z_0}\tan(\beta l_f) \quad \text{Eq. 10}$$

As shown in Eq. 8, the admittance $Y_{rs}$ of the radiating strip line 310 is transformed to a specific ratio 1/k through the electromagnetic coupling and is shown at the both ends 322A and 322B of the feeding strip line 320.

According to Eq. 9, the entire conductance $G_a$ of the antenna 300 can be controlled by the real number part $R_{rs}$ of the radiating strip line and the impedance step-up ratio k between the radiating strip line and the feeding strip line when the radiating strip line 310 is resonated, that is, $f=f_c$, which means u=0. The impedance step-up ratio k is decided by the length ratio $l_f/l_r$ and the width ratio $w_f/w_r$ of the radiating strip line and the feeding strip line.

Figure 5:
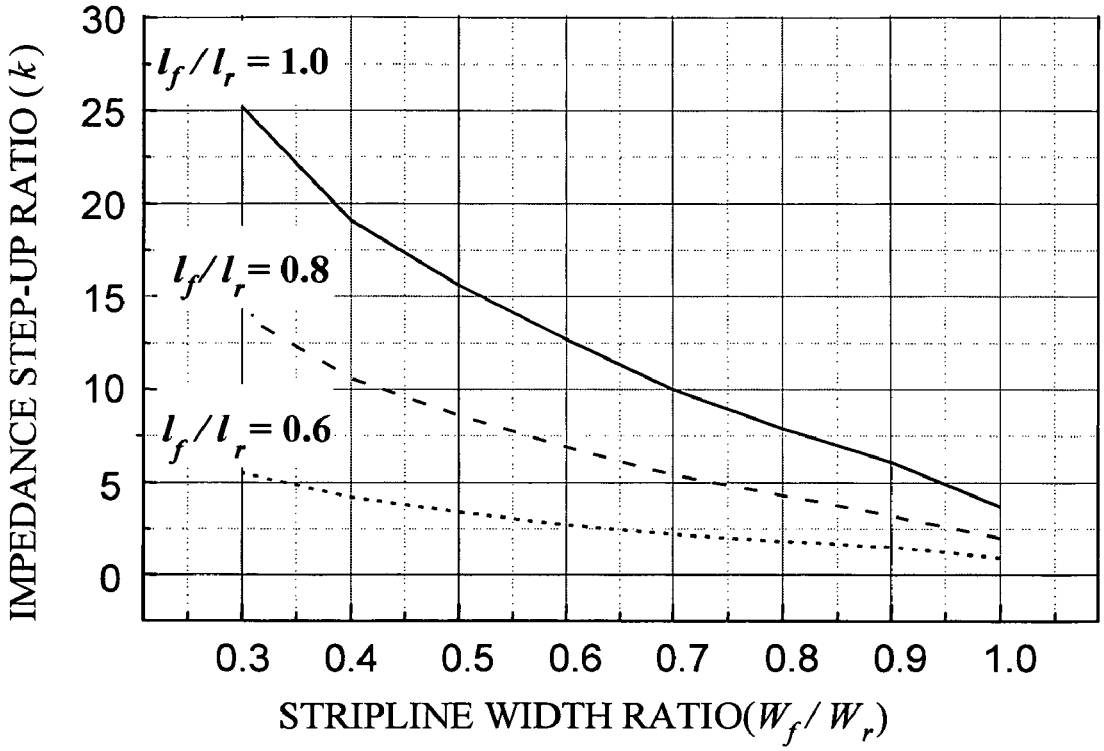
FIG. 5 shows a impedance step-up ratio k according to the variation of a length ratio and a width ratio of a radiating strip line to a feeding strip line in the tag antenna shown in FIG. 3.

FIG. 5 shows the impedance step-up ratio k according to the variation of the length ratio $l_f/l_r$ and the width ratio $w_f/w_r$ of the radiating strip line and the feeding strip line in the tag antenna shown in FIG. 3. The impedance step-up ratio k of FIG. 5 is obtained from the tag antenna having the structure shown in FIG. 3 which has 0.127 mm of a thickness t and 2.2 of the relative dielectric constant with p=7 mm, d=19 mm and $W_r$=2.5 mm. As shown in FIG. 5, the impedance step-up ratio k becomes larger, as the width ratio of the radiating strip line to the feeding strip line becomes smaller and the length ratio of the radiation strip line to the feeding strip line becomes larger.

According to Eq. 10, the susceptance $B_a$ of the entire tag antenna 300 can be controlled by controlling only the susceptance $B_t$ of the transmission line composed of two strip lines when the radiating strip line 310 is resonated, $f=f_c$ which means u=0. After the input admittance $Y_c=G_c+jB_c$ of the RF front-end of the element to access the antenna is given, the susceptance $B_a$ of the tag antenna 300 according to the present invention must be controlled to have the identical magnitude and the opposite sign compared to the susceptance $B_c$ of the element to be connected for conjugate-matching. According to Eq. 10, the antenna susceptance $B_a$ at the resonant frequency is $B_r/2$. Therefore, the antenna susceptance $B_a=B_r/2$ can be controlled to be $-B_c$ at the resonant frequency by controlling the characteristics impedance $Z_o$ of the transmission line and the length if of the feeding strip line. The characteristic impedance $Z_o$ of the transmission line can be controlled by controlling the thickness and the dielectric constant of the substrate, and the widths of the two strip lines.

Since the conductance $G_a$ and the susceptance $B_a$ of the entire antenna 300 are influenced at the resonant frequency by both of the line width and the length of the two strip lines according to Eqs. 9 and 10, the conductance $G_a$ and the susceptance $B_a$ cannot be controlled independently. Generally, the length and width of the feeding strip line are controlled at first to make the susceptance $B_a=B_r/2$ to be $-B_c$, and then, the width ratio of the two strip lines is controlled in order to control the impedance step-up ratio k to satisfy $1/(kR_{rs})=G_c$.

In general, the RF front-end of the passive RFID tag chip has a capacitive reactance due to the characteristics of a rectifier and detector circuit. Therefore, the impedance of the tag antenna should have an inductive reactance. That is, the range of $\beta l_f$ can be expressed as Eq. 11.

$$\left(n+\frac{1}{2}\right)\pi<\beta l_f<(n+1)\pi \qquad \text{Eq. 11}$$

In Eq. 11, n is an integer number and it denotes a minimum length of a feeding strip line when n=0.

In Eq. 10, the first term has a negative slop and the second term has a positive slop as the frequency f increases at around the resonant frequency $f_o$. Therefore, $B_a$ has a comparatively smaller slop because the slops of two terms of Eq. 10 are attenuated each other at the resonant frequency. Since the antenna structure according to the present invention can reduce the susceptance variation of the entire antenna according to the frequency variation, the impedance matching between the tag antenna 123 and the RF front-end 121 can be achieved in the broadband.

Figure 6:
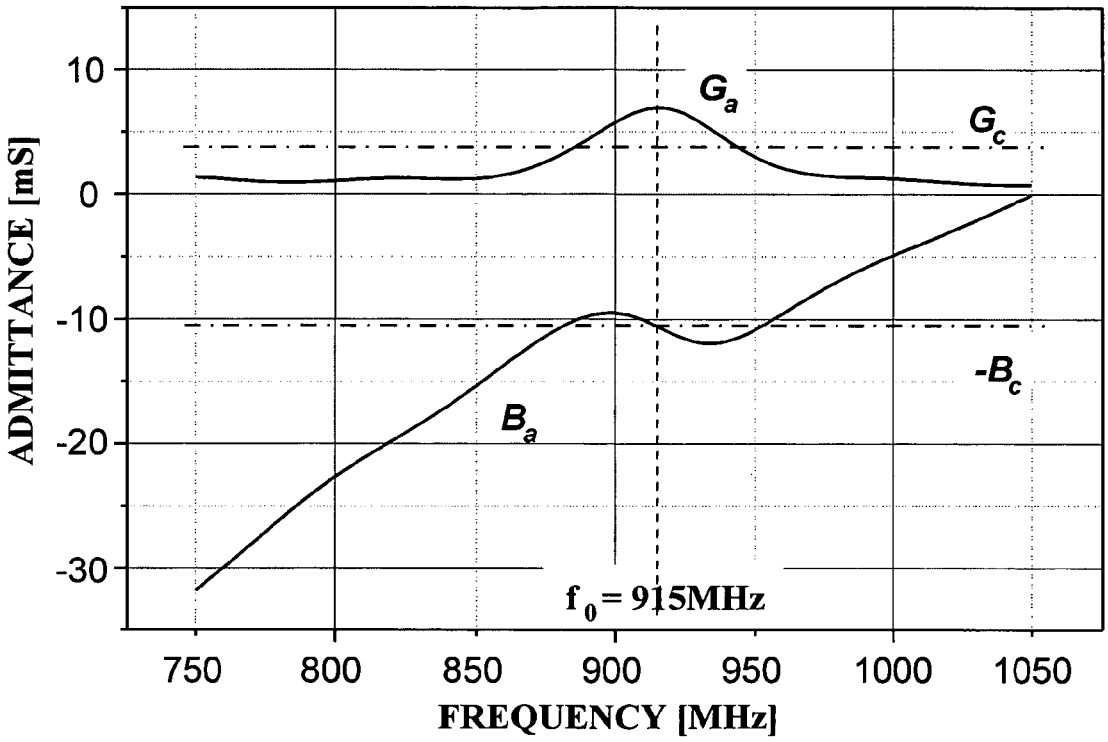
FIG. 6 is a graph showing the variation of an input admittance $Y_a$ of a tag antenna of FIG. 3 according to the frequency variation.

FIG. 6 is a graph showing the variation of input admittance $Y_a$ of the tag antenna 300 according to the frequency variation. The input admittance $Y_a$ is obtained under the identical conditions of FIG. 5 with $l_f/l_r=0.8$ and $w_f/w_r=0.6$.

The graph of FIG. 6 shows that each of the $G_a$ and $B_a$ has a symmetry structure with a center as the resonant frequency $f_o$. The $B_a$ has the maximum point and the minimum point where the sign of the impedance slop changes as the frequency increases at around the resonant frequency $f_o$. It is a typical characteristic of the admittance. FIG. 6 also shows the admittance $Y_c$=3.7+j 10.6 [ms] of the RF front-end 121 of the RFID tag chip. That is, it clearly shows that the conjugate matching is well achieved at around the resonant frequency $f_o$ of the tag antenna 300.

Figure 7:
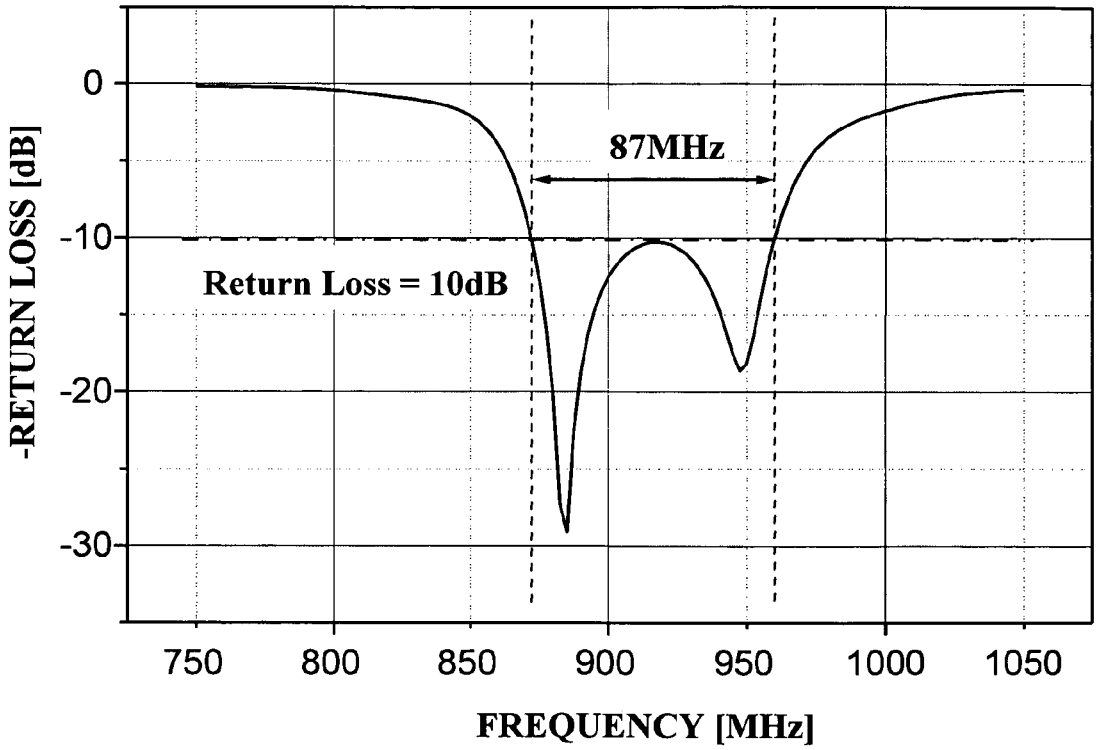
FIG. 7 is a graph showing return loss between an RF front-end 121 and a tag antenna of FIG. 3.

FIG. 7 is a graph showing return-loss between a tag antenna 300 and an RF front-end 121, which is calculated using the result of FIG. 6.

That is, FIG. 7 shows that the tag antenna 300 according to the present embodiment has a broad impedance bandwidth wider than 80 MHz at around 915 MHz of the center frequency based on the return-loss higher than 10 dB as a reference. The tag antenna 300 used for a simulation has a size of about 70 mm×21.5 mm and includes a substrate having about 2.2 relative dielectric constant and having a thickness of about 0.217 mm. If a conventional antenna has the size, the relative dielectric constant and the thickness identical to those of the tag antenna 300, it is very difficult for the conventional antenna to have a bandwidth wider than 50 MHz. However, if the tag antenna 300 according to the present embodiment is used, the effective broadband matching to the RF front-end 121 having predetermined impedance can be achieved as shown in FIG. 7.

As shown in FIG. 3, the radiating strip line 310 and the feeding strip line 320 have the meander structure with a uniform line width, and the center line of the feeding strip line 320 is matched with the center line of the radiating strip line 310. However, it is obvious to those skilled in the art that the impedance step-up ratio can be controlled by changing the relative location and the line width of the two strip lines although the line widths of the two strip lines are not identical and the center lines of the two strip lines are not matched.

The radiating strip line 310 and the feeding strip line 320 also have the meander structure as shown in FIG. 3. However, it is obvious to those skilled in the art that a well known dipole structure may be applied to the radiating strip line 310 and the feeding strip line 320.

The RFID tag is generally attached to an object. Since the resonant frequency of the radiating strip line 310 is influenced by the structure and the electrical characteristic of the target object where the RFID tag is attached, the radiating strip line 310 must be designed with regard to the structure and the electrical characteristics of the target object.

The tag antenna 300 according to the present invention can be manufactured as follows. At first, a conductive material is stacked on a substrate in a form of a thin film having a thickness of about 0.1 mm. As the substrate, a hard material including glass, ceramic, Teflon, epoxy and FR4, or a thin and flexible organic material including polyimide, paper and plastic may be used. Since the resonant frequency of the antenna may vary according to the electric characteristics and the thickness of the substrate, the electric characteristics and the thickness of the substrate are sufficiently regarded when the antenna is designed. Examples of the conductive materials include copper, copper alloy, aluminum and conductive ink. The antenna pattern of the conductive material is formed on the substrate through etching, deposition, or printing. The radiating strip line 310 and the feeding strip line 320 may be manufactured with different conductive materials or using different manufacturing methods.

Since the tag antenna 300 according to the present invention has the radiating strip line 310 and the feeding strip line 320 having open ends in a direct current (DC) manner, the tag antenna 300 does not require a via formed to penetrate the substrate. Therefore, the manufacturing cost of the tag can be reduced thereby.

The tag antenna according to the present invention has advantages as follows. In the tag antenna according to the present invention, the antenna impedance is controlled using the open-ended two strip meander lines. Therefore, the effective broadband matching to the antenna element having predetermined complex impedance can be achieved.

Also, the effective impedance matching to the RF front-end having a large capacitive reactance against a resistance can be obtained through the electromagnetic coupling of the radiating strip line and the feeding strip line without requiring additional matching circuit. Therefore, small and light tag antenna can be manufactured.

Furthermore, the tag antenna according to the present invention does not use via that penetrates the substrate because the ends of the radiating strip line and the feeding strip line are open in DC manner. Therefore, the tag antenna according to the present invention reduces a manufacturing cost of a tag and allows mass production.

The present application contains subject matter related to Korean patent application Nos. KR2005-0068549 and KR2006-0012796 filed with the Korean patent office on Jul. 27, 2005, and Feb. 10, 2006, respectively, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. An antenna comprising:

a substrate;

a radiating strip line for deciding a resonant frequency of the antenna disposed on a first surface of the substrate; and a feeding strip line for providing a radio frequency (RF) signal to an element connected to the antenna disposed on a second surface of the substrate opposite the first surface, wherein the feeding strip line comprises a first end portion and a second end portion separated from the first end portion so as to define a terminal between the first end portion and the second end portion of the feeding strip line, wherein ends of the radiating strip line and the feeding strip line are open.

2. The antenna as recited in claim 1, wherein the terminal included between the first end portion and the second end portion of the feeding strip line is for accessing to an element connected to the antenna.

3. The antenna as recited in claim 1, wherein a centerline of the radiating strip line and a center line of the feeding strip line are matched to each other.

4. The antenna as recited in claim 2, wherein the length of the feeding strip line is shorter than the length of the radiating strip line.

5. The antenna as recited in claim 4, wherein an input impedance is controlled using a characteristic that an impedance of the radiating strip line is shown at the terminal of the feeding strip line by being transformed to a predetermined impedance step-up ratio through an electromagnetic coupling of the radiating strip line and the feeding strip line.

6. The antenna as recited in claim 5, wherein the input impedance is controlled based on a characteristic that a real number part of an admittance of the antenna varies according to the impedance step-up ratio.

7. The antenna as recited in claim 6, wherein the input impedance is controlled based on a characteristic that the real number part of the admittance of the antenna is reduced as the impedance step-up ratio increases.

8. The antenna as recited in claim 6, wherein the input impedance is controlled based on a characteristic that the impedance step-up ratio varies according to a length ratio of the radiating strip line to the feeding strip line.

9. The antenna as recited in claim 8, wherein the input impedance is controlled based on a characteristic that the impedance step-up ratio increases as the length ratio of the radiating strip line to the feeding strip line increases.

10. The antenna as recited in claim 8, wherein the input impedance is controlled based on a characteristic that the impedance step-up ratio varies according to a width ratio of the radiating strip line to the feeding strip line.

11. The antenna as recited in claim 10, wherein the input impedance is controlled based on a characteristic that the impedance step-up ratio increase as the width ratio of the radiating strip line to the feeding strip line is reduced.

12. The antenna as recited in claim 4, wherein the input impedance is controlled based on a characteristic that a real number part of an admittance of the antenna varies according to a real number part of an impedance of the radiating strip line.

13. The antenna as recited in claim 12, wherein the input impedance is controlled based on a characteristic that a real number of the antenna admittance is reduced as the real number part of the impedance of the radiating strip line increases.

14. The antenna as recited in claim 4, wherein the input impedance is controlled based on a characteristic that an imaginary number of the antenna admittance varies according to a characteristic impedance of a transmission line formed by the radiating strip line and the feeding strip line.

15. The antenna as recited in claim 14, wherein the input impedance is controlled based on a characteristic that an imaginary number part of the antenna admittance increases as the characteristic impedance of the transmission line is reduced.

16. The antenna as recited in claim 14, wherein the input impedance is controlled based on a characteristic that a characteristic impedance of the transmission line varies according to line widths of the radiating strip line and the feeding strip line.

17. The antenna as recited in claim 14, wherein an input impedance is controlled based on a characteristic that a characteristic impedance varies according to a thickness and a dielectric constant of the substrate.

18. The antenna as recited in claim 4, wherein an input impedance is controlled based on a characteristic that an imaginary number part of the antenna impedance varies according to a length of a transmission line formed by the radiating strip line and the feeding strip line.

19. The antenna as recited in claim 18, wherein the length of the transmission line is the length of the feeding strip line.

20. The antenna as recited in claim 18, wherein the length of the transmission line is controlled to make the imaginary number part of the antenna impedance to be an inductive reactance.

21. The antenna as recited in claim 18, wherein a value of multiplying the length of the transmission line and the propagation constant of the transmission line is greater than $(n+\frac{1}{2})*\pi$, and smaller than $(n+1)*\pi$, where n is an integer greater than 0.

22. The antenna as recited in claim 4, wherein the radiating strip line and the feeding strip line have a meander structure.

23. The antenna as recited in claim 4, wherein the radiating strip line and the feeding strip line have a dipole structure.

24. The antenna as recited in claim 4, wherein an input impedance is controlled based on a characteristic that the antenna impedance varies according to relative locations of the radiating strip line and the feeding strip line.

25. A radio frequency identification (RFID) tag, comprising:

an antenna for receiving an RF signal transmitted from an RFID reader;

a RF front-end for rectifying and detecting the RF signal; and a signal processing unit connected to the RF front-end, wherein the antenna includes:

a radiating strip line for deciding a resonant frequency of the antenna; and a feeding strip line for providing a radio frequency (RF) signal to an element connected to the antenna, the feeding strip line comprising a first end portion and a second end portion separated from the first end portion so as to define a terminal between the first end portion and the second end portion of the feeding strip line, and wherein ends of the radiating strip line and the feeding strip line are open.

26. The RFID tag as recited in claim 25, wherein the feeding strip line includes a terminal for accessing the element connected to the antenna.

27. The RFID tag as recited in claim 26, wherein the radiating strip line and the feeding strip line are disposed at different sides of a substrate, and the length of the feeding strip line is shorter than the length of the radiating strip line.

28. The RFID tag as recited in claim 27, wherein an input impedance is controlled based on a characteristic that an impedance of the radiating strip line is shown at the terminal of the feeding strip line by being transformed to a predetermined impedance step-up ratio through an electromagnetic coupling of the radiating strip line and the feeding strip line.

29. The RFID tag as recited in claim 28, wherein the input impedance is controlled based on a characteristic that a real number part of an admittance of the antenna varies according to the impedance step-up ratio.

30. The RFID tag as recited in claim 29, wherein the input impedance is controlled based on a characteristic that the impedance step-up ratio varies according to a length ratio of the radiating strip line to the feeding strip line.

31. The RFID tag as recited in claim 29, wherein the input impedance is controlled based on a characteristic that the impedance step-up ratio varies according to a width ratio of the radiating strip line to the feeding strip line.

32. The RFID tag as recited in claim 27, wherein the input impedance is controlled based on a characteristic that a real number part of an admittance of the antenna varies according to a real number part of an impedance of the radiating strip line.

33. The RFID tag as recited in claim 27, wherein the input impedance is controlled based on a characteristic that an imaginary number of the antenna admittance varies according to a characteristic impedance of a transmission line formed by the radiating strip line and the feeding strip line.

34. The RFID tag as recited in claim 27, wherein the input impedance is controlled based on a characteristic that a characteristic impedance of the transmission line varies according to line widths of the radiating strip line and the feeding strip line.

35. The RFID tag as recited in claim 26, wherein an input impedance is controlled based on a characteristic that a characteristic impedance varies according to a thickness and a dielectric constant of the substrate.

36. The RFID tag as recited in claim 27, wherein an input impedance is controlled based on a characteristic that an imaginary number part of the antenna impedance varies according to a length of a transmission line formed by the radiating strip line and the feeding strip line.

37. The RFID tag as recited in claim 36, wherein the length of the transmission line is the length of the feeding strip line.

38. The RFID tag as recited in claim 36, wherein the length of the transmission line is controlled to make the imaginary number part of the antenna impedance an inductive reactance.

39. The RFID tag as recited in claim 27, wherein the radiating strip line and the feeding strip line have a meander structure.

40. The RFID tag as recited in claim 27, wherein the antenna is resonated at an RF signal frequency transmitted from the RFID reader, and is conjugate-matched at the front-end.

41. The RFID tag as recited in claim 27, wherein the substrate is one of glass, ceramic, teflon, epoxy, and FR-4.

42. The RFID tag as recited in claim 27, wherein the substrate is an organic material.

43. The RFID tag as recited in claim 27, wherein the conductive material used for the radiating strip line and the feeding strip line is one selected from the group consisting of copper, copper alloy, aluminum, and conductive ink.

44. The RFID tag as recited in claim 27, wherein the radiating strip line and the feeding strip line are manufactured with different conductive materials.

45. The RFID tag as recited in claim 27, wherein the radiating strip line and the feeding strip line are manufactured through one of etching, depositing and printing.

46. The RFID tag as recited in claim 27, wherein the radiating strip line and the feeding strip line are manufactured using different methods.

47. An antenna impedance matching method for an open-ended strip line antenna, the antenna impedance matching method comprising the step of:

matching an impedance based on a characteristic that an impedance of the radiating strip line is shown at the terminal of the feeding strip line by being transformed to a predetermined impedance step-up ratio through an electromagnetic coupling of the radiating strip line and the feeding strip line, wherein the open-ended strip line antenna includes having a radiating strip line for deciding a resonant frequency of the antenna, and a feeding strip line for providing an RF signal to an element connected through a terminal, where the feeding strip line and the radiating strip line are disposed at both sides of a substrate and are electromagnetically coupled with each other.

48. The antenna impedance matching method as recited in claim 47, wherein the impedance matching is performed based on a characteristic that a real number part of an admittance of the antenna varies according to the impedance step-up ratio.

49. The antenna impedance matching method as recited in claim 48, wherein the impedance matching is performed based on a characteristic that the impedance step-up ratio varies according to a length ratio and a width ratio of the radiating strip line to the feeding strip line.

50. The antenna impedance matching method as recited in claim 48, wherein the impedance matching is performed based on a characteristic that a real number part of an admittance of the antenna varies according to a real number part of an impedance of the radiating strip line.

51. The antenna impedance matching method as recited in claim 47, wherein the impedance matching is performed based on a characteristic that an imaginary number of the antenna admittance varies according to a characteristic impedance of a transmission line formed by the radiating strip line and the feeding strip line.

52. The antenna impedance matching method as recited in claim 51, wherein the impedance matching is performed based on a characteristic that a characteristic impedance of the transmission line varies according to line widths of the radiating strip line and the feeding strip line.

53. The antenna impedance matching method as recited in claim 51, wherein the impedance matching is performed based on a characteristic that an imaginary number part of the antenna impedance varies according to a length of a transmission line formed by the radiating strip line and the feeding strip line.

* * * * *